US007247783B2

(12) United States Patent
Grossman

(10) Patent No.: US 7,247,783 B2
(45) Date of Patent: Jul. 24, 2007

(54) COOPERATIVE MUSICAL INSTRUMENT

(76) Inventor: Richard Grossman, 2000 De Mile Dr., Los Angeles, CA (US) 90027

( * ) Notice: Subject to any disclaimer, the term of this patent is extended or adjusted under 35 U.S.C. 154(b) by 257 days.

(21) Appl. No.: 11/040,957

(22) Filed: Jan. 22, 2005

(65) Prior Publication Data

US 2006/0162533 A1 Jul. 27, 2006

(51) Int. Cl.
*G10H 1/00* (2006.01)

(52) U.S. Cl. ..... 84/600; 84/600; 381/86

(58) Field of Classification Search ..... None
See application file for complete search history.

(56) References Cited

U.S. PATENT DOCUMENTS 3,482,029 A * 12/1969 Sines ..... 84/722
3,786,167 A * 1/1974 Borell et al. ..... 84/701
4,219,962 A * 9/1980 Dankman et al. ..... 446/409
4,270,226 A * 5/1981 Weintraub et al. ..... 455/353
4,334,221 A * 6/1982 Rosenhagen et al. ..... 463/6
4,352,310 A * 10/1982 Orlandoni ..... 84/718
4,635,518 A * 1/1987 Meno ..... 84/722
4,938,483 A * 7/1990 Yavetz ..... 463/5
5,270,480 A * 12/1993 Hikawa ..... 84/645
5,438,154 A * 8/1995 Segan et al. ..... 84/600
5,550,319 A * 8/1996 Segan et al. ..... 84/103
5,670,732 A * 9/1997 Utsumi et al. ..... 84/645
6,110,000 A * 8/2000 Ting ..... 446/302
6,175,872 B1 * 1/2001 Neumann et al. ..... 709/231
6,198,034 B1 * 3/2001 Beach et al. ..... 84/600
6,245,976 B1 * 6/2001 Sander ..... 84/320
6,254,486 B1 * 7/2001 Mathieu et al. ..... 463/52
6,290,566 B1 * 9/2001 Gabai et al. ..... 446/175
6,381,515 B1 * 4/2002 Inoue et al. ..... 700/245
6,415,439 B1 * 7/2002 Randell et al. ..... 725/153
6,439,956 B1 * 8/2002 Ho ..... 446/454
6,491,566 B2 * 12/2002 Peters et al. ..... 446/454

(Continued)

*Primary Examiner*—Lincoln Donovan
*Assistant Examiner*—Robert W. Horn
(74) *Attorney, Agent, or Firm*—Paul J. Backofen, Esq.; Crockett & Crockett

(57) ABSTRACT

A series of musical vehicles form a cooperative musical instrument. Each musical vehicle may be outfitted with a musical tone generator and horn, or loud speaker that plays a particular note on a music scale. Each musical vehicle may have multiple horns or speakers having a predetermined tonal separation between each horn or speaker. For example, the B flat vehicle may have 5 horns that play a series of five of the B-flat notes having a predetermined tonal separation between each note. Each of the horns or speakers on each musical vehicle may be separately activated so that, for example, the B vehicle would sound a middle B when the middle B signal is activated. The horns or speakers may be permanently mounted or preferably mounted on a rack that can be moved from vehicle to vehicle. Each horn or speaker may be activated by a separate musical command signal, or a common radio signal using encoded signals to select one or more notes from one or more of the musical cars, transmitted from a control system which may be located in fixed location, in a separate vehicle or in one of the musical vehicles. The control system may include a keyboard which can be operated to cause music to be generated by the group of vehicles. The command system may receive musical input from a cd or cassette or other suitable device which plays a pre-recorded piece of music through the musical vehicles.

4 Claims, 3 Drawing Sheets

U.S. PATENT DOCUMENTS 6,529,802 B1 * 3/2003 Kawakita et al. ..... 700/245
6,560,511 B1 * 5/2003 Yokoo et al. ..... 700/245
6,656,012 B1 * 12/2003 DeAngelis et al. ..... 446/454
6,661,351 B1 * 12/2003 Matsushiro ..... 340/825.69
6,684,127 B2 * 1/2004 Fujita et al. ..... 700/245
6,697,719 B2 * 2/2004 Stouffer et al. ..... 701/36
6,729,934 B1 * 5/2004 Driscoll et al. ..... 446/297
6,773,322 B2 * 8/2004 Gabai et al. ..... 446/91
6,773,344 B1 * 8/2004 Gabai et al. ..... 463/1
6,780,077 B2 * 8/2004 Baumgartner et al. ..... 446/175
6,780,078 B2 * 8/2004 Hageman et al. ..... 446/175
6,822,154 B1 * 11/2004 Thai ..... 84/609
6,848,968 B2 * 2/2005 Weiss et al. ..... 446/454
6,947,893 B1 * 9/2005 Iwaki et al. ..... 704/258
6,952,156 B2 * 10/2005 Arshad et al. ..... 340/5.6
6,968,176 B2 * 11/2005 Juzswik ..... 455/411
6,969,795 B2 * 11/2005 Hofmeister et al. ..... 84/600
7,002,483 B2 * 2/2006 Alrabady ..... 340/825.69
7,025,657 B2 * 4/2006 Nishimoto ..... 446/484
7,029,361 B2 * 4/2006 Seibert et al. ..... 446/327
7,062,356 B2 * 6/2006 Takamura et al. ..... 700/259
7,068,941 B2 * 6/2006 Fong et al. ..... 398/107
7,069,127 B2 * 6/2006 Stouffer et al. ..... 701/36
7,089,083 B2 * 8/2006 Yokoo et al. ..... 700/245
2006/0162533 A1 * 7/2006 Grossman ..... 84/600
2006/0207409 A1 * 9/2006 Kavana ..... 84/600

* cited by examiner

COOPERATIVE MUSICAL INSTRUMENT

BACKGROUND OF THE INVENTION

1. Field of the Invention

This invention relates to cooperative musical instruments and more specifically to large-scale cooperative musical instruments using multiple motorized vehicles.

2. Description of the Prior Art

Musical performances are popular elements of public gatherings such as parades. What is needed is a technique for large-scale cooperative musical performance.

SUMMARY OF THE INVENTION

According to the present disclosure a series of musical vehicles form a cooperative musical instrument. Each musical vehicle may be outfitted with a musical tone generator and horn, or loud speaker that plays a particular note on a music scale. Each musical vehicle has multiple horns or speakers having a predetermined tonal separation between each horn or speaker. For example, the B flat vehicle may have 5 horns that play a series of five of the B-flat notes having a predetermined tonal separation between each note. Each of the horns or speakers on each musical vehicle may be separately activated so that, for example, the B vehicle would sound a middle B when the middle B signal is activated. The horns or speakers may be permanently mounted or preferably mounted on a rack that can be moved from vehicle to vehicle. Each horn or speaker may be activated by a separate musical command signal, or a common radio signal using encoded signals to select one or more notes from one or more of the musical cars, transmitted from a control system which may be located in fixed location, in a separate vehicle or in one of the musical vehicles. The control system may include a keyboard which can be operated to cause music to be generated by the group of vehicles. The command system may receive musical input from a cd or cassette or other suitable device which plays a pre-recorded piece of music through the musical vehicles. The musical vehicles may be used in parades or caravans to play music.

In a currently preferred embodiment of the present disclosure, a cooperative musical instrument includes a series of 12 musical vehicles, each musical vehicle is outfitted with a set of musical tone generators and horns, or loud speakers that plays a particular note on the chromatic scale. Each musical vehicle has 5 horns pitched at octaves, so that the B flat car will have 5 horns that play five adjacent B-flat notes that appear on a musical keyboard.

In another aspect, a group of vehicles form a cooperative musical instrument according to the present disclosure. Each vehicle includes apparatus sufficient to perform 4–8 preselected notes, each note separated by a predetermined amount such as an octave. The combination of notes available in the group of vehicles forms a musical scale.

In another aspect, the present disclosure provides a multichannel receiver in each musical vehicle. Each multi-channel receiver dedicates a channel to a single note. For example, in a vehicle dedicated to play the A note, channel one may handle the A at 110 Hz, and channel two may handle the A at 220 Hz, and channel three may handle the A at 440 Hz, and channel four may handle the A at 880 Hz, and channel five may handle the A at 1760 Hz. The output of each receiver channel may be directed to a dedicated tone generator preset for the dedicated note. The output from the tone generator or other suitable device may be applied to a horn or speaker dedicated for each note.

In a further aspect of the present disclosure each musical vehicle is equipped with a command decoder to decode a composite musical command code to extract note commands for the note the musical vehicle is dedicated to play. The musical command decoder may then drive one or more tone generators or other suitable devices for generating the commanded note or notes. The one or more tone generators may then drive a dedicated horn or speaker for each note or a composite system to perform all the notes a given musical vehicle is dedicated to perform.

These and other features and advantages of this invention will become further apparent from the detailed description and accompanying figures that follow. In the figures and description, numerals indicate the various features of the invention, like numerals referring to like features throughout both the drawings and the description.

DETAILED DESCRIPTION OF THE PREFERRED EMBODIMENT(S)

Figure 1:
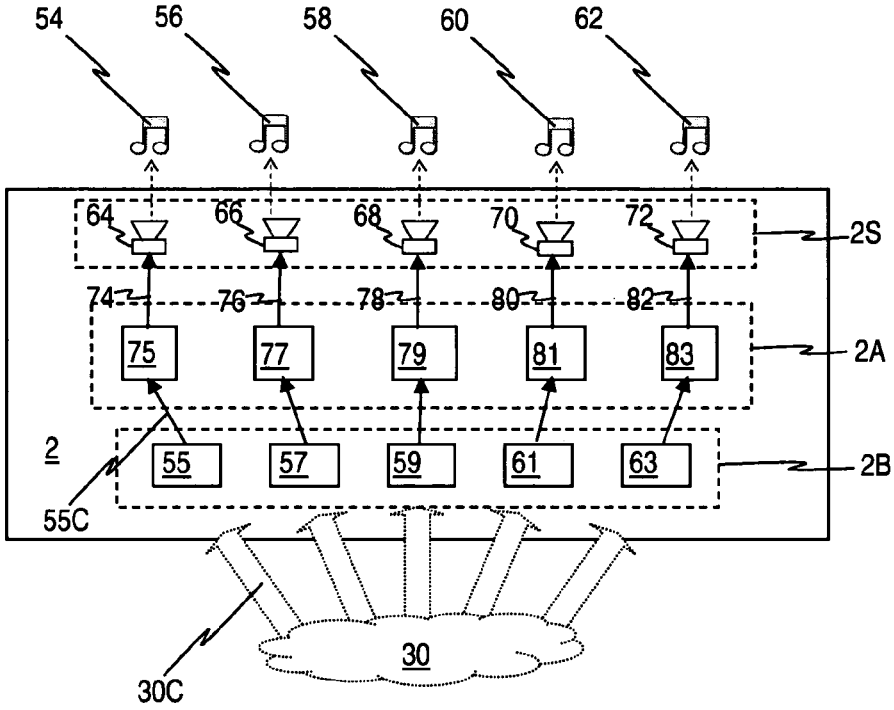
FIG. 1 is a block diagram of musical vehicle according to the present disclosure.

Referring now to FIG. 1, according to the present disclosure a musical vehicle 2 may include one or more note command receivers 55, 57, 59, 61 and 63 which drive tone generators 75, 77, 79, 81 and 83 respectively. Tone generators 75, 77, 79, 81 and 83 produce note drive signals 74, 76, 78, 80 and 82 respectively, the note drive signals may be applied to horns or speakers 64, 66, 68, 70 and 72 respectively to generate notes 54, 56, 58, 60 and 62 respectively. Command receivers 55, 57, 59, 61 and 63 may also perform command processing. Commands such as command 30 may be received by command receivers 55, 57, 59, 61 and 63 and processed to determine if a note is to be produced by speakers 64, 66, 68, 70 and 72 respectively. If for example, command receiver 55 receives command 30C for speaker 64 to produce low C at about 64.4 HZ, command receiver decodes command stream 30 to distinguish and processes command 30C which results in drive signal 55C which is applied to tone generator 75 to produce audio or note drive signal 74 which is applied to speaker 64 to produce low C at about 64.4 Hz.

In another aspect of the present disclosure, note command receivers 55, 57, 59, 61 and 63 may be separate components, or subdivisions or channels of receiver 2B. Similarly, tone generators 75, 77, 79, 81 and 83 may be separate components, or subdivisions or channels of audio generator or driver 2A. Likewise, speakers 64, 66, 68, 70 and 72 may be separate components or may be replaced by a single element 2S having a sufficiently wide performance spectrum to accommodate notes 54, 56, 58, 60 and 62.

Figure 2:
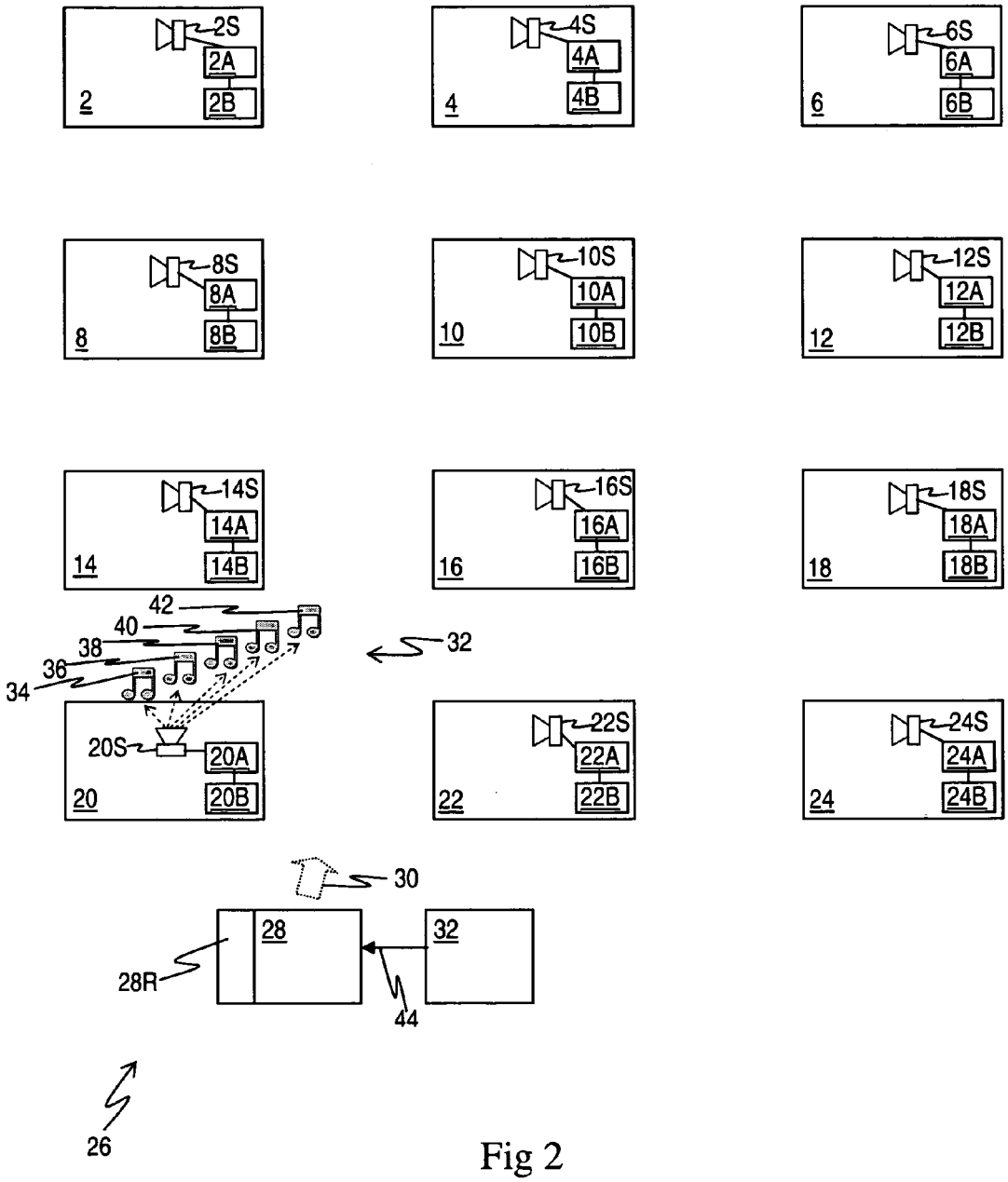
FIG. 2 is a block diagram of cooperative musical instrument according to the present disclosure.

Referring now to FIG. 2, cooperative musical instrument 26 includes 12 musical vehicles such as musical vehicles 2, 4, 6, 8, 10, 12, 14, 16, 18, 20, 22 and 24. Each musical vehicle such as musical vehicle 20 may play multiple musical notes 32. In a currently preferred embodiment of the present disclosure musical notes 34, 36, 38, 40 and 42 are identical musical notes each separated by an octave. For example, notes 32 may be an A and note 38 may the A above middle C which is conventionally identified as being 440 Hz. Thus, note 34 would be 110 Hz, and note 36 would be 220 Hz, and note 40 would be 880 Hz, and note 42 would be 1760 Hz.

If each musical vehicle of cooperative musical instrument 26 performs a different note of a scale such as the chromatic scale, and each musical vehicle performs 5 notes separated by an octave, the combination of notes available from cooperative musical instrument 26 would be a complete 5-octave scale. Thus, musical vehicle 2 may perform 5 octaves of C, musical vehicle 4 may perform 5 octaves of C-sharp or D-flat, musical vehicle 6 may perform 5 octaves of D, musical vehicle 8 may perform 5 octaves of D-sharp or E-flat, musical vehicle 10 may perform 5 octaves of E, musical vehicle 12 may perform 5 octaves of F, musical vehicle 14 may perform 5 octaves of F-sharp or G-flat, musical vehicle 16 may perform 5 octaves of G, musical vehicle 18 may perform 5 octaves of G-sharp or A-flat, musical vehicle 20 may perform 5 octaves of A, musical vehicle 22 may perform 5 octaves of A-sharp or B-flat, and musical vehicle 24 may perform 5 octaves of B.

Musical vehicles 2, 4, 6, 8, 10, 12, 14, 16, 18, 20, 22 and 24 may be any suitable conveyance such as automobiles or other motorized vehicles or mobile conveyances. The musical vehicles may move in many coordinated arrangements. For example, musical vehicles 2, 4, 6, 8, 10, 12, 14, 16, 18, 20, 22 and 24 may move in unison in a variety of arrangements such as single file, two abreast, three abreast, line abreast, and staggered arrangements. One or more subsets of cooperative musical instrument 26 may also move in coordinated arrangements similar to elements of a marching band participating in a field show.

In alternate embodiments of the present disclosure different numbers of musical vehicles may be used and each vehicle may perform between 4 and 8 notes having predetermined separations to generate different musical scales or modes such as major or minor scales, whole tone scales, pentatonic scales, diminished scales, jazz modes and Gregorian modes.

Again referring to FIG. 2, each musical vehicle N may include a remote receiver and processor NB and audio generator NA. For example, musical vehicle 2 may include a remote receiver and processor 2B and audio generator 2A, and musical vehicle 24 may include a remote receiver and processor 24B and audio generator 24A.

Each remote receiver and processor such as remote receiver and processor 2B may receive analog or digital wireless signals such as command stream 30 from remote controller 28. Command stream 30 may be decoded by each remote receiver and processor such as remote receiver and processor 2B and then applied to the appropriate audio generator such as audio generator 2A.

Each audio generator such as audio generator 2A may include one or more speakers, tone generator and horn or other suitable apparatus.

Musical source 32 generates drive signal 44 which may be applied to remote controller 28. Musical source 32 may be a keyboard or any suitable source providing musical output such as cd or cassette tape player for replay of one or more prerecorded audio performances. Musical source 32 may produce analog or digital output using any suitable format such as MIDI or USB. Additionally, recorder 28R may be used to record command stream 30 to permit replay of a performance. Recorder 28R may also capture drive signal 44 in addition to command stream 30 or as an alternative. Musical source 32 and remote controller 28 may be co-located in a musical vehicle, a separate vehicle or a suitable stationary location.

Figure 3:
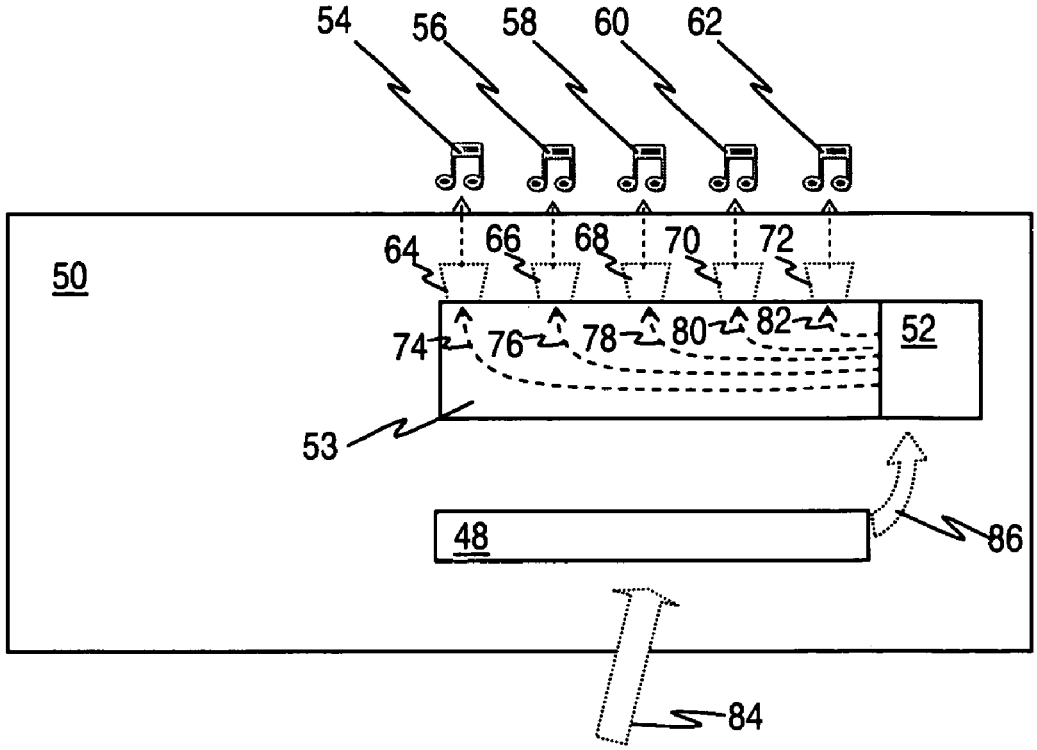
FIG. 3 is a detailed block diagram of an alternate musical vehicle according to the present disclosure.

Referring now to FIG. 3, in an alternate embodiment of the present disclosure, a musical vehicle such as musical vehicle 50 may include audio driver 52 and audio array 53. Audio array 53 may include 4–8 audio elements such as audio element 64. Audio array 53 may be permanently secured to musical vehicle 50 or audio array 53 may be removably secured to a vehicle to permit moving the array to another vehicle.

Signal 84 from a remote controller such as remote controller 28 of FIG. 1 may be analog or digital, coded or uncoded. Signal 74 may be processed by receiver 48, producing drive signal 86 which is applied to audio driver 52.

Audio driver 52 may provide drive signals 74, 76, 78, 80 and 82 to audio elements 64, 66, 68, 70 and 72 respectively, to produce notes 54, 56, 58, 60 and 62 respectively. Notes 54, 56, 58, 60 and 62 may have predetermined separation such as one octave. Any suitable separation may be used.

Having now described the invention in accordance with the requirements of the patent statutes, those skilled in the art will understand how to make changes and modifications in the present invention to meet their specific requirements or conditions. Such changes and modifications may be made without departing from the scope and spirit of the invention as set forth in the following claims.

I claim:

1. A cooperative musical instrument comprising:

a plurality of musical vehicles, each vehicle playing a different note of a musical scale, each musical vehicle having a tone generator driven by a note command receiver; each musical vehicle performing 4 or more notes, each of the 4 or more notes of a musical vehicle separated by an octave each from the other;

a command generator for creating and transmitting commands to the plurality of note command receivers.

2. The cooperative musical instrument of claim 1 wherein the plurality of musical vehicles further comprises:

a plurality of musical vehicles, the 4 or more notes of each of the plurality of musical vehicles combining to form a chromatic scale.

3. A cooperative musical instrument comprising:

a plurality of musical vehicles, each vehicle playing a different note of a musical scale, each musical vehicle having an audio array driven by an audio driver which receives signals from a command receiver, each musical vehicle performing 4 or more notes, each of the 4 or more notes of a musical vehicle separated by an octave each from the other;

a command generator for creating and transmitting commands to the plurality of command receivers.

4. The cooperative musical instrument of claim 3 wherein the plurality of musical vehicles further comprises:

a plurality of musical vehicles, the 4 or more notes of each of the plurality of musical vehicles combining to form a chromatic scale.

* * * * *